US008259020B1

(12) United States Patent
Macy et al.

(10) Patent No.: US 8,259,020 B1
(45) Date of Patent: Sep. 4, 2012

(54) ANTENNA SYSTEM FOR SATELLITE COMMUNICATION

(75) Inventors: David F. Macy, Mission Viejo, CA (US); Timothy E. Macy, Aliso Viejo, CA (US); Steven R. Mills, Mission Viejo, CA (US)

(73) Assignee: Trivec-Avant Corporation, Huntington Beach, CA (US)

( * ) Notice: Subject to any disclaimer, the term of this patent is extended or adjusted under 35 U.S.C. 154(b) by 481 days.

(21) Appl. No.: 12/533,992

(22) Filed: Jul. 31, 2009

(51) Int. Cl.
*H01Q 3/08* (2006.01)
*H01Q 1/32* (2006.01)

(52) U.S. Cl. ..... 343/766; 343/713; 343/760; 343/894; 342/359

(58) Field of Classification Search ..... 343/711, 343/713, 757, 760, 761, 763, 765, 766, 819, 343/833, 834, 880–882, 894, 915; 342/359
See application file for complete search history.

(56) References Cited

U.S. PATENT DOCUMENTS

| | | | | |
|---|---|---|---|---|
| 2,094,475 | A * | 9/1937 | Schwarzhaupt | 343/752 |
| 4,460,895 | A * | 7/1984 | Bert et al. | 343/713 |
| 5,223,845 | A | 6/1993 | Eguchi | |
| 5,929,817 | A * | 7/1999 | Clark | 343/713 |
| 6,016,120 | A | 1/2000 | McNabb | |
| 6,122,595 | A | 9/2000 | Varley | |
| 6,195,060 | B1 | 2/2001 | Spano | |
| 6,204,823 | B1 | 3/2001 | Spano | |
| 6,313,800 | B1 * | 11/2001 | Kallina | 343/715 |
| 6,377,211 | B1 | 4/2002 | Hsiung | |
| 6,408,251 | B1 | 6/2002 | Azuma | |
| 6,606,074 | B1 * | 8/2003 | Allnutt | 343/815 |
| 6,842,991 | B2 | 1/2005 | Levi | |

OTHER PUBLICATIONS

K50E, Eggbeater II Antenna, http://members.aol.com/k5o3jerry/eggbeater2.htm, Jun. 22, 2002.

* cited by examiner

*Primary Examiner* — Michael C Wimer
(74) *Attorney, Agent, or Firm* — Knobbe Martens Olson & Bear LLP

(57) ABSTRACT

An antenna system for satellite communication, mounted on a moving platform, includes an antenna assembly, a control and display unit, and an antenna steering unit. The antenna assembly includes a dipole driven element assembly and at least one director element mounted on an antenna mast. The antenna steering unit includes a support housing, a rotary joint comprising a BNC connector, an electronic magnetic compass. an angular velocity-sensing gyroscope, a global positioning system receiver, a signal processor and a motor. The direction of the antenna's azimuth axis is determined based on the heading of the moving platform determined by the signal processor. In one embodiment, the director elements, the antenna mast and the azimuth mast are all articulated on flexible joints comprising a cable and spring mechanism allowing the director elements to fold toward the antenna mast and allowing the antenna assembly to fold toward the azimuth mast for stowing.

16 Claims, 11 Drawing Sheets

ANTENNA SYSTEM FOR SATELLITE COMMUNICATION

BACKGROUND OF THE INVENTION

1. Field of the Invention

The present invention relates to an antenna system for satellite communication.

2. Description of the Related Technology

Maritime satellite communications were started in 1976 using the Marisat system. In 1982, Marisat was handed over to the internationally organized Inmarsat system and has been in operation since then. Since 1982, the United States military has placed in orbit several satellite systems used for communication.

The Ultra High Frequency Satellite Communications (UHF SATCOM) system provides communication links, via satellite, between designated mobile units and shore sites worldwide. The UHF SATCOM system is one of three SATCOM systems installed, and operates in the UHF range. The SATCOM systems, combined, represent a composite of information exchange systems that use the satellites as relays for communications and control as well as quality monitoring subsystems that provide data to manage satellite resources. UHF SATCOM generally involves vehicle earth station antennas having a desired amount of gain. Ground vehicles on-the-move (OTM) have usually been limited to low data rates (voice) and use "omni" antennas that use circular polarization and are pointed straight up. For higher gain, high data rate communications to low elevation satellites, where the omni antennas have too low gain, man-portable high gain adjustable pointing antennas have been used at halt. To achieve high data rate OTM communications to low elevation satellites, high gain antennas must usually be used and these high gain antennas must usually be pointed dynamically as the vehicle maneuvers. As the operators are usually very busy and are used to the near-zero attention required by the SATCOM omnis and antennas of their other communications systems, a steerable antenna should also help to minimize workload on the operator.

Directional antennas, such as parabolic reflector antennas or yagi type antennas, are commonly housed under domes. A radome is usually necessary to make the antenna resistant to object collisions. The radome is usually mounted on a radome base and is removable to facilitate maintenance and repair work. Such radomes may be easily identifiable on a vehicle and may attract unwanted attention.

Highly directional antenna systems installed on a moving platform are usually steerable so as to adequately receive radio waves from remote satellites. To continuously point in the direction of the satellite under platform heading motions, the antenna is commonly steered by mechanical or electronical means. A variety of technologies have been developed to steer the antenna to point at the satellite under heading changes.

Global positioning system (GPS) receivers are commonly used in such steering systems to provide a moving platform's track, wherein the track is the vehicle's course over ground. Generally, a land-based vehicle's track will be coincident with its heading. However, there are several situations in which the vehicle's, heading is not adequately provided by the GPS receiver. These situations include: inadequate GPS reception, low speeds where the GPS track is inherently noisy, and vehicles backing up. In one example, a moving vehicle which has been parked, in which the steering system has been turned off, and which has subsequently shifted direction before turning the steering system back on will have a heading that is different than its track. When the vehicle is turned back on, the vehicle will be pointing in a direction that is different than the last known track of the GPS receiver. An antenna steering system which can assess the vehicle's heading in all situations is needed.

Antenna systems installed on moving platforms also need to be malleable to obstacles such as, for example, tree branches, bridges with low clearance, etc.

SUMMARY

These and other problems are solved by a new and improved antenna system for satellite communication which compensates for various changes in a vehicle's track relative to its heading, and which has a flexible structure which allows it to prevent damage from obstacles such as tree branches, bridges with low clearance, etc.

In one embodiment, an antenna system for satellite communication, mounted on a moving platform, includes an antenna assembly; a control and display unit; and an antenna steering unit. The antenna assembly includes a dipole driven element assembly and at least one director element mounted on an antenna mast. The antenna steering unit includes a support housing, a rotary joint comprising a BNC connector, wherein the BNC connector has a first part connected to the support housing of the antenna steering unit, and a second part connected to the antenna assembly at the axis of rotation, such that when the antenna rotates, the BNC connector rotates in synchronism with it; an electronic magnetic compass for sensing the Earth magnetic field to determine a reference azimuth; an angular velocity-sensing gyroscope for sensing motion and outputting an angular velocity output signal; a global positioning system receiver for providing track of the moving platform; a signal processor in communication with the electronic magnetic compass, the angular velocity-sensing gyroscope and the global positioning system receiver for receiving the reference azimuth, the angular velocity output signal, and the track, and determining the heading of the moving platform using an adaptive time interval; and a motor that controls direction of the antenna's azimuth axis, wherein the direction of the antenna's azimuth axis is determined based on the heading of the moving platform determined by the signal processor.

In one embodiment, the elevation angle of the antenna mast is manually adjusted.

In one embodiment, the antenna assembly further includes a reflector assembly.

In one embodiment, the dipole is linear-polarized.

In one embodiment, the dipole is circular-polarized.

In one embodiment, the dipole is elliptical-polarized.

In one embodiment, the antenna system further includes an azimuth mast.

In one embodiment, the electronic magnetic compass includes a sensor and a calibration table.

In one embodiment, the signal processor further comprises Kalman filters.

In one embodiment, the control and display unit is used by an operator of the moving platform for inputting selection of a satellite with which to communicate.

In one embodiment, the control and display unit includes a power switch, a user interface, user controls, at least one processor and a serial data bus for communication with the antenna steering unit.

In one embodiment the user interface includes an LCD array of at least one line of at least sixteen alpha-numeric characters.

In one embodiment, the user controls include a backlight dimmer for the user interface, a rotary knob comprising of at least twenty increments per rotation for inputting data, a button for selection of pages for display, and a button for accepting data.

In one embodiment, the pages include at least a page to display status, a page to display satellite information and a page to display data.

In one embodiment, an antenna system for satellite communication includes an antenna assembly, comprising a reflector assembly, a dipole driven element assembly, and at least one director element mounted on an antenna mast; an azimuth mast. The at least one director element, the antenna mast and the azimuth mast are articulated on flexible joints comprising a cable and spring mechanism allowing the at least one director element to fold toward the antenna mast and allowing the antenna assembly to fold toward the azimuth mast for stowing.

In one embodiment, the at least one director element folds forward towards the antenna mast.

In one embodiment, the at least one director element folds backward towards the antenna mast.

In one embodiment, an antenna system for satellite communication mounted on a moving platform includes an antenna assembly, a control and display unit, a support housing, a rotary joint comprising a BNC connector, wherein the BNC connector has a first part connected to the support housing of the antenna steering unit, and a second part connected to the antenna assembly at the axis of rotation, such that when the antenna rotates, the BNC connector rotates in synchronism with it, an electronic magnetic compass for sensing the Earth magnetic field to determine a reference azimuth, an angular velocity-sensing gyroscope for sensing motion and outputting an angular velocity output signal, a global positioning system receiver for providing track of the moving platform, a signal processor in communication with the electronic magnetic compass, the angular velocity-sensing gyroscope and the global positioning system receiver for receiving the reference azimuth, the angular velocity output signal, and the track, and determining the heading of the moving platform using an adaptive time interval and a motor that controls direction of the antenna's azimuth axis, wherein the direction of the antenna's azimuth axis is determined based on the heading of the moving platform determined by the signal processor. The antenna assembly includes a dipole driven element assembly and at least one director element mounted on an antenna mast.

In one embodiment, an antenna system for satellite communication, mounted on a moving platform, includes an antenna assembly; a control and display unit; and an antenna steering unit. The antenna assembly includes a dipole driven element assembly and at least one director element mounted on an antenna mast. The antenna steering unit includes a support housing, a rotary joint comprising a BNC connector, wherein the BNC connector has a first part connected to the support housing of the antenna steering unit, and a second part connected to the antenna assembly at the axis of rotation, such that when the antenna rotates, the BNC connector rotates in synchronism with it; an electronic magnetic compass for sensing the Earth magnetic field to determine a reference azimuth; an angular velocity-sensing gyroscope for sensing motion and outputting an angular velocity output signal; a signal processor in communication with the electronic magnetic compass, the angular velocity-sensing gyroscope and the angular velocity output signal, and determining the heading of the moving platform using an adaptive time interval; and a motor that controls direction of the antenna's azimuth axis, wherein the direction of the antenna's azimuth axis is determined based on the heading of the moving platform determined by the signal processor.

DETAILED DESCRIPTION

Figure 1A:
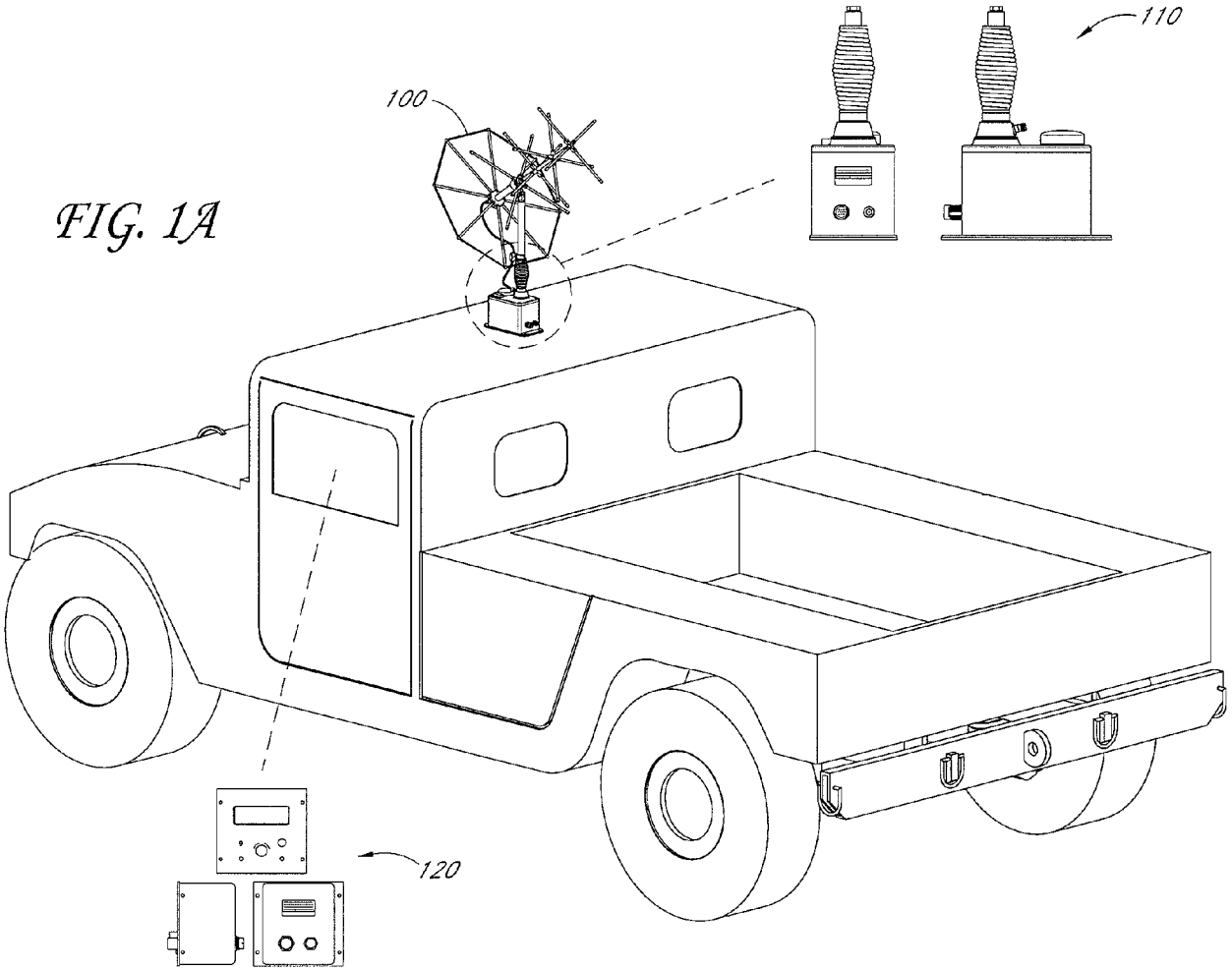
FIG. 1A shows an embodiment of the antenna system for satellite communication mounted on a vehicle.
Figure 1B:
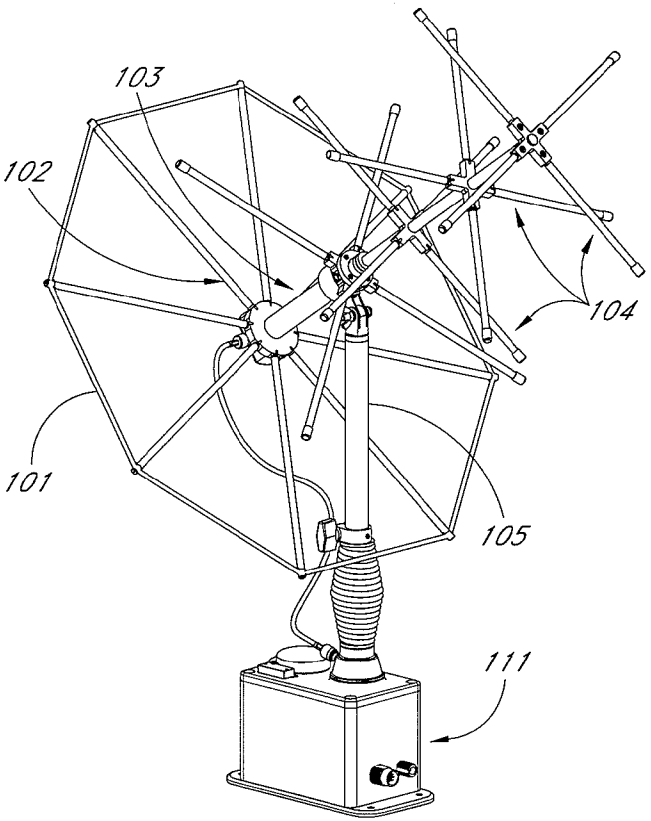
FIG. 1B shows details on an embodiment of the antenna unit of the embodiment of the antenna system shown in FIG. 1.

FIG. 1A shows an embodiment of the antenna system for satellite communication mounted on a moving platform. The antenna system can be mounted on a moving platform such as a vehicle, and can be used for satellite communications, or for receiving a satellite broadcasting signal. The antenna system includes an antenna unit 100, an antenna steering unit (ASU) 110 and a control and display unit (CDU) 120. The antenna unit 100 and the ASU 110 are mounted atop a vehicle, with the antenna azimuth mast placed vertically. The CDU 120 is placed in the vehicle cockpit. As shown in FIG. 1B, in one embodiment, the antenna unit 100 includes a reflector assembly 101, an orthogonal dipole driven element assembly 102, and three director elements 104 mounted on an antenna mast 103. The antenna unit 100 also includes an azimuth mast 105. The dipoles may be linear-polarized, circular-polarized, or any form of elliptical polarized. The antenna director elements 104 are mounted to the azimuth mast 105 through an elevation joint. In one embodiment, the elements 104, the antenna mast 103, and the azimuth mast 105 are articulated on flexible joints (as described below in reference to FIG. 2A). The mast 105 in turn is mechanically and electrically provided to the ASU housing 111. In one embodiment, the ASU includes a support housing 111, a rotary BNC connector joint, an electronic magnetic compass, an angular velocity-sensing gyroscope, a global positioning system (GPS) receiver, a signal processor and a motor. In one embodiment, the ASU housing 111 is machined aluminum construction and the input/output signals pass through RF filters to preclude interference from high RF fields typically present in the environment where the antenna is mounted.

In one embodiment, the low-visibility profile, collapsible, directive antenna system has a steering function as well as a satellite location function, and a flexible antenna capability. The antenna system can be used for pointing toward a satellite in a geosynchronous orbit, from a stationary platform, or with UHF Satellite Communications DAMA terminals in vehicles enabling communication on-the-move (COTM). In one embodiment, maximum antenna gain is around +8 dBiC (nominal) at boresight. The 3 dB beamwidth is 90° (nominal).

The antenna flexibility helps prevent damage by objects such as tree branches, bridges with low clearance, etc., that may strike the antenna while it is moving on a platform. A flexible antenna design allows the antenna to fold down when struck by an obstacle such as a tree branch or foliage, and to pop back up when the obstacle is past (see FIG. 3B). The flexibility of the antenna system also discourages vehicle operators from using the antenna as a handhold.

The flexibility of the antenna also helps to overcome the need for a protective dome commonly used to protect the antenna from damage of striking obstacles. The absence of a dome can contribute to lower the cost of producing the antenna and to provide a measure of stealth for military operations. For example, the antenna system can include an open thin element antenna painted to blend into the background and thus provide low observability at a distance. In one embodiment, the element antenna can be painted in a relatively dark color.

The antenna system is steerable in order to steer the antenna against changes in the heading of a moving platform. In one embodiment, the system includes a self-steering directional antenna that automatically points to an earth-stationary satellite and maintains pointing despite heading changes made by a moving platform vehicle. In order to maintain adequate reception of signals, it is desirable for such a vehicle-mounted antenna system to include a directional antenna element which can be rotated relative to the vehicle in order to track the satellite as the orientation of the vehicle changes. It is also desirable for the antenna to be relatively small and lightweight in order to facilitate easy mounting on the vehicle. The elevation angle of the antenna mounted on the moving platform can be adjusted manually, with the aid of the CDU 120, which are explained further below. As also explained further below, once mounted on the moving platform, the steerable antenna system controls the direction of the antenna and the directivity of the beam by compensating for the position and heading changes of the moving platform, such that the antenna reliably points in the direction of the desired satellite at all times.

The antenna steering function is enabled by the ASU 110, which helps maintain the Line-of-Sight (LOS) direction in space of the UHF antenna despite directional changes of the vehicle on which it is mounted. In one embodiment, pointing is accomplished by automatically holding the earth referenced yaw rotation (azimuth) of the antenna fixed after slewing the antenna LOS to the bearing of the desired satellite relative to the coordinate system of the vehicle. True pointing azimuth is achieved by calculating the desired LOS relative bearing as the difference between the desired azimuth and the vehicle's heading and forcing the measured relative bearing to match. The stability and accuracy of the pointing system over the range of the vehicle's motion is within the beamwidth of the antenna pattern.

Figure 2A:
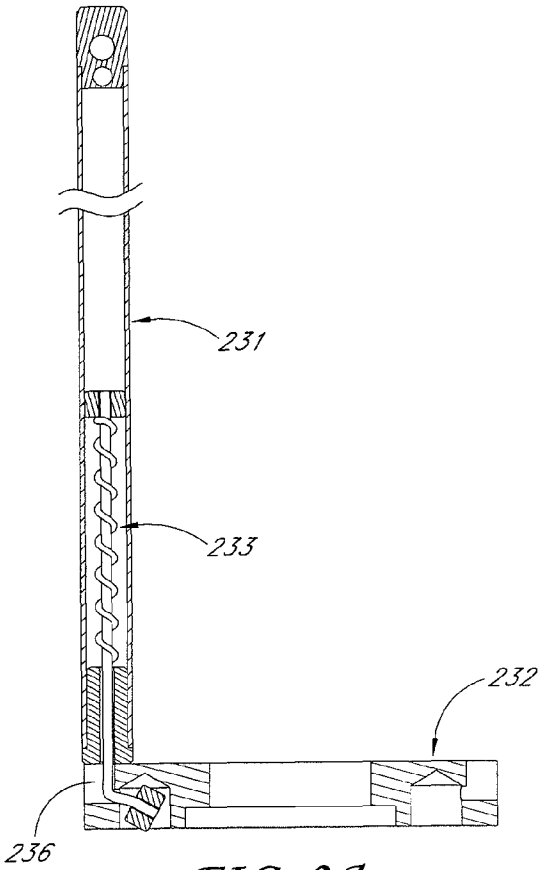
FIGS. 2A, 2B and 2C show details of an embodiment of the flexible joints of the antenna system.
Figure 2B:
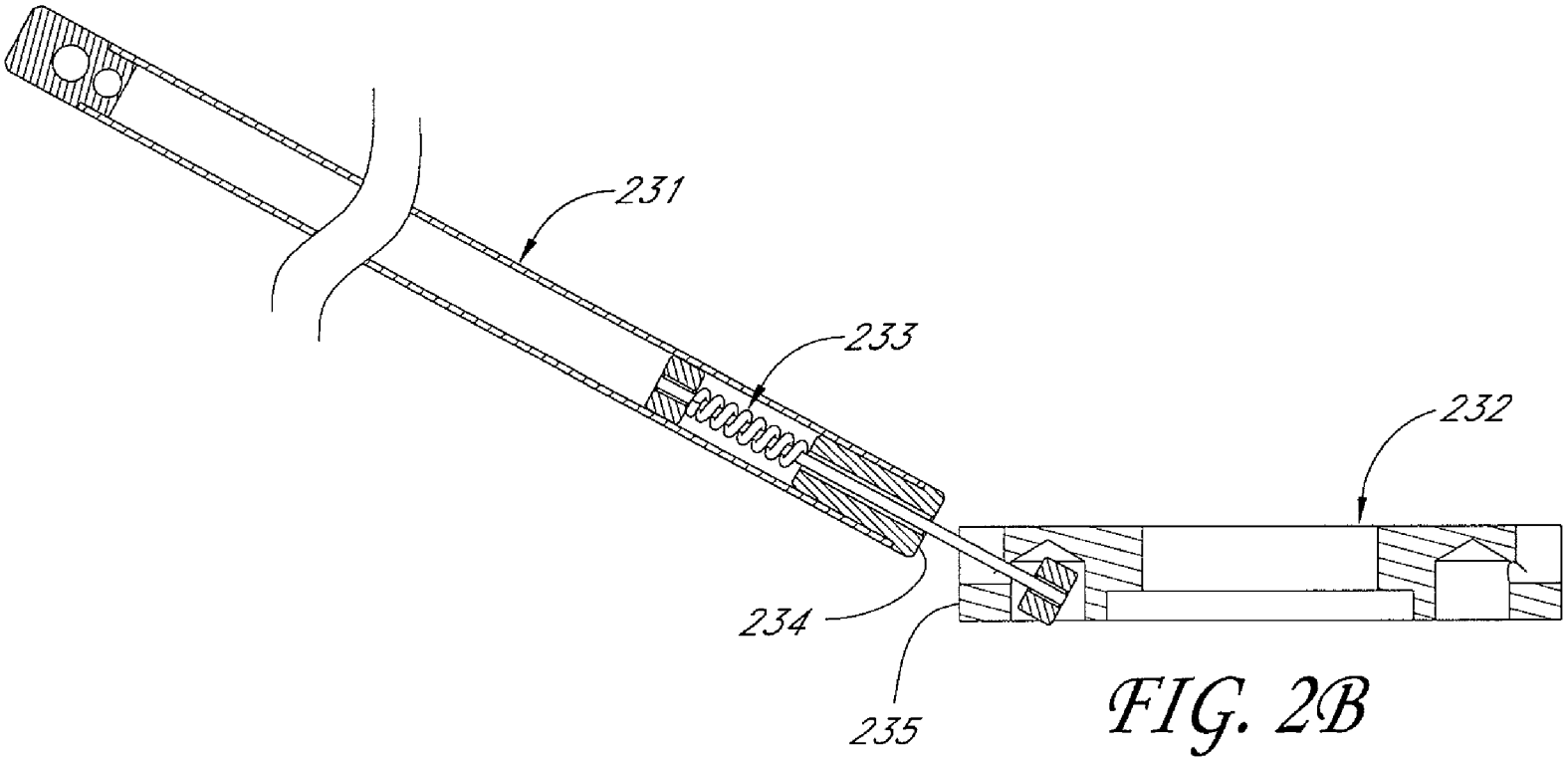
Figure 2C:
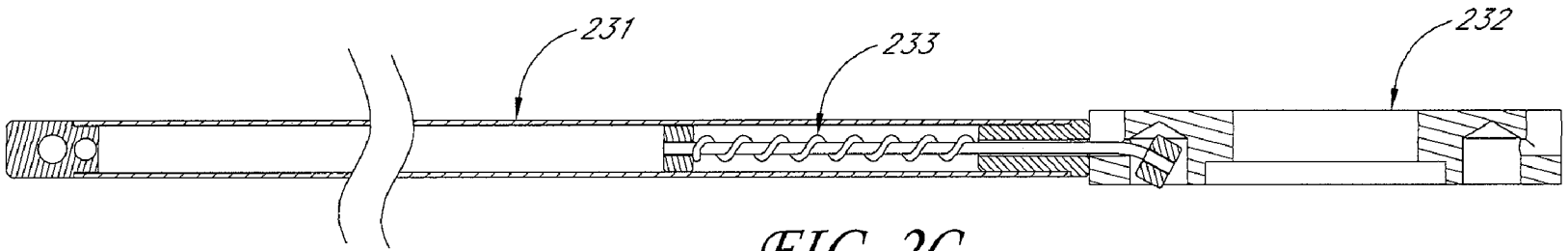

As mentioned above, the elements 104, the antenna mast 103, and the azimuth mast 105 of the antenna unit 100 are articulated as flexible joints. FIGS. 2A, 2B and 2C show details of an embodiment of these flexible joints. When the antenna is in its deployed position, the antenna director elements 104, the antenna mast 103 and the azimuth mast 105 are in their erected position, as seen in FIG. 2A. In that position, the erected element 231, through slot 236, is engaged in mast socket 232. When it is desired to fold and stow away the antenna system, or, when the antenna unit gets hit, for example by a tree branch, force exerted on the erected element 231 will cause the element 231 to bend toward the mast socket 232, as shown in FIG. 2B. In the case of obstruction, for example by a tree branch, the element 231 remains engaged in the socket through slot 236, and when the force of the obstruction is removed, the mast cable and spring mechanism 233 causes the element 231 to return to its erected position, as in FIG. 2A. If it is desired to fold the antenna for stowage, exertion of force on the element 231, of sufficient intensity to extend the mast cable and spring mechanism 233 enough to disengage the element 231 from the mast socket 232 allows the element 231 to be folded, as in FIG. 2C. The cable and spring mechanism 233 is designed such that it holds a first face 234 against a second face 235 with a force strong enough to hold the antenna up and weak enough to allow the antenna system to flex in the face of an obstruction and to fold for stowage. In one embodiment, the first face 234 and the second face 235 are flat. In another embodiment, the first face 234 and the second face 235 are slightly convex or slightly concave.

Figure 2D:
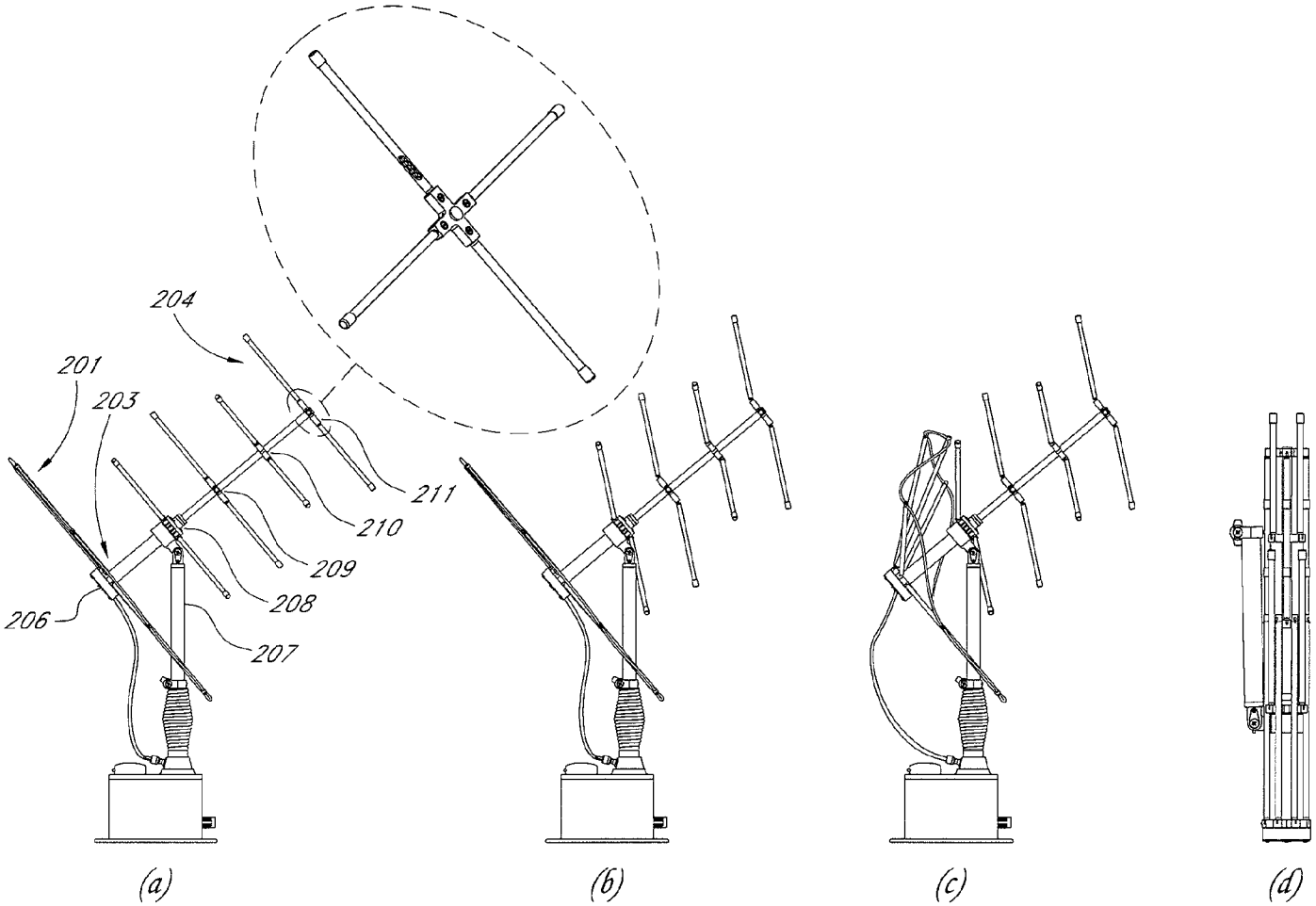
FIG. 2D shows an embodiment of the antenna system in a folded configuration.

FIG. 2D shows an embodiment of the antenna system, in transition from a deployed to a folded configuration for stowage. As shown in FIG. 2D, the antenna can be folded from its deployed configuration, (a), to its stowed configuration, (d), using the flexible joints 206, 207, 208, 209, 210 and 211 located wherever the antenna system's elements articulate]. As shown in (b), the antenna director elements 204 are folded toward the antenna mast 203 by virtue of the flexible joints described in reference to FIGS. 2A, 2B and 2C. Some of the director elements 204 can be folded forward, and some of the director elements 204 can be folded backward. As shown in (c), the reflector assembly 201 is also folded toward the antenna mast 203.

Figure 2E:
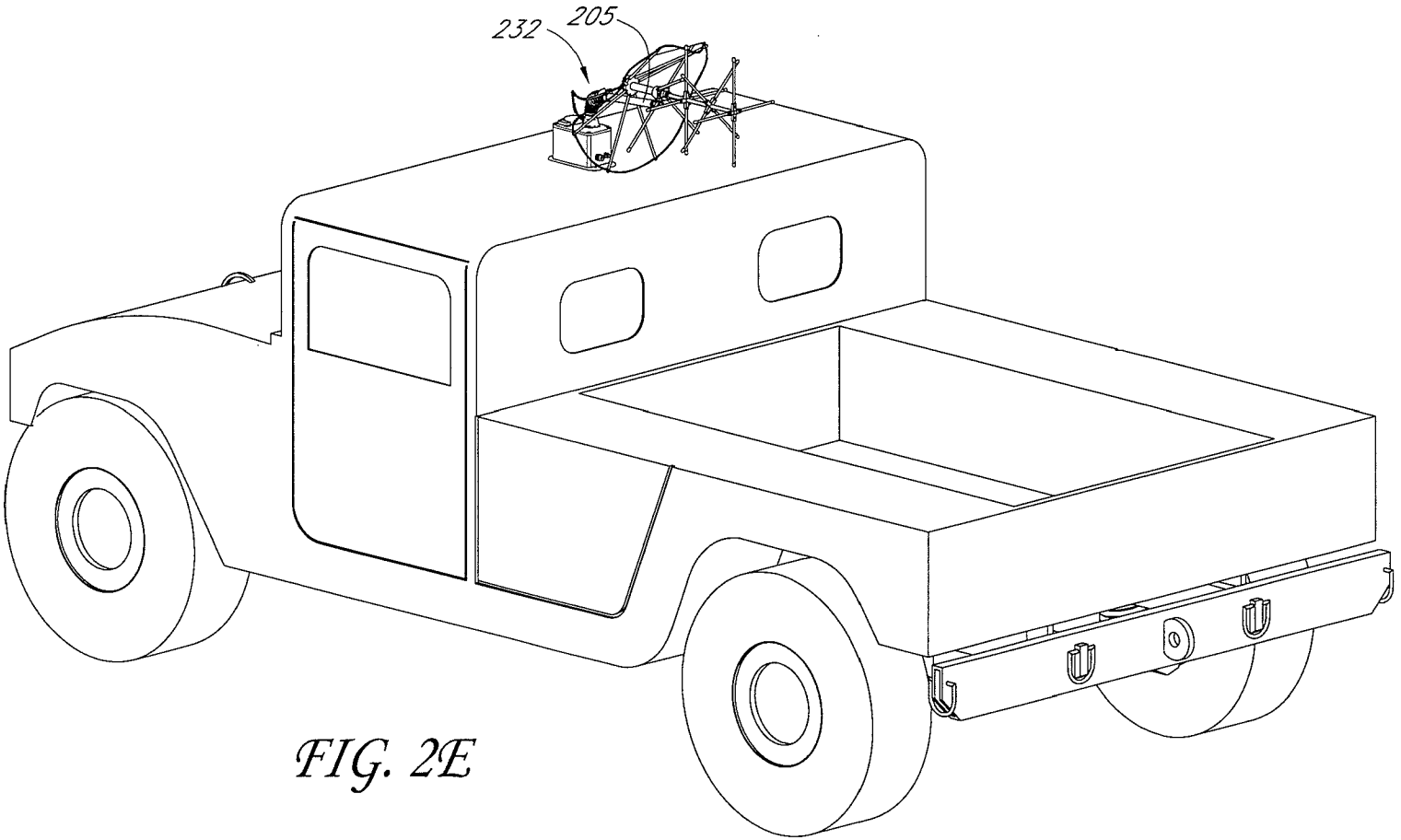
FIG. 2E shows an embodiment of the antenna system in the presence of an obstruction.

FIG. 2E shows an embodiment of the antenna system, in the presence of an obstruction. As explained in reference to FIGS. 2A, 2B and 2C, the flexible joint connecting the antenna mast 205 to the antenna director elements 204 allows the mast 205 to fold down towards the mast socket 232, thereby preventing damage to the antenna assembly by moving the antenna assembly away from the obstruction.

Figure 3:
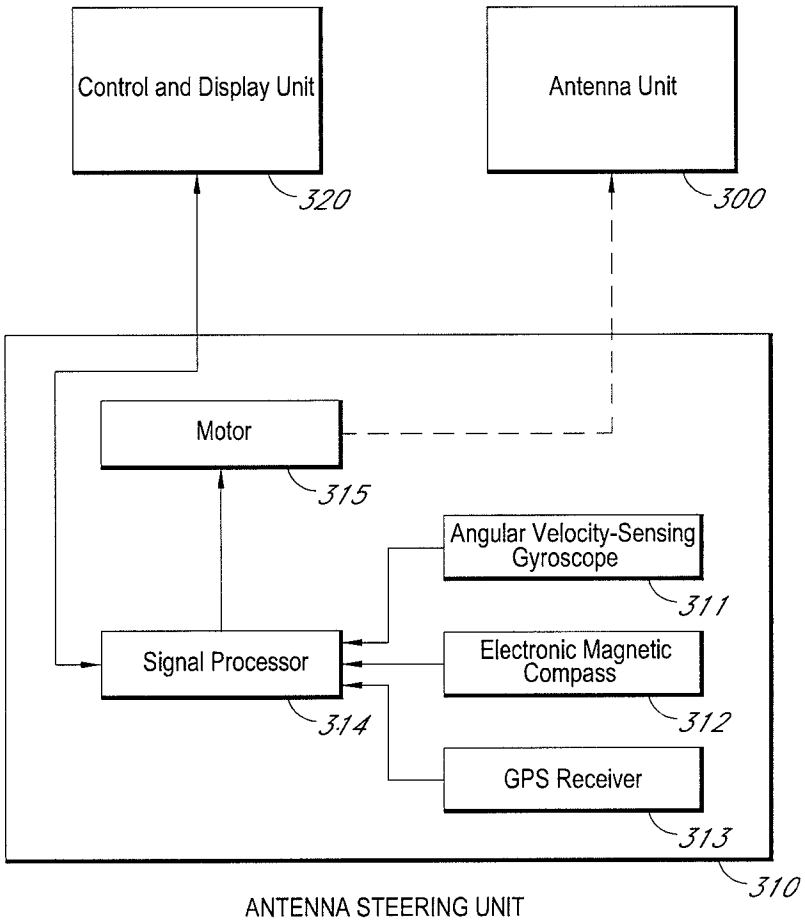
FIG. 3 is a block diagram of the components of an embodiment of the ASU.

As described in reference to FIG. 1A above, the antenna unit 100 is connected to the ASU 110. FIG. 3 shows a block diagram of the components of an embodiment of the ASU 310. The ASU 310 includes an angular velocity-sensing gyroscope 311, an electronic magnetic compass 312, and a GPS receiver 313, which are in communication with a signal processor 314, which in turn controls a motor 315. The motor 315 is used to rotate the azimuth axis of the antenna system through the ASU 310 connection to the antenna unit 300. The ASU 310 signal processor 314 includes memory and/or a database which is loaded from time to time with satellite orbital information as a function of time. The memory can be loaded through the user CDU 320, which is also connected to the ASU 310.

The satellite azimuth is the angle from true north of the horizontal component of the line-of-sight (LOS) to the satellite, the heading is the angle from true north of the vehicle's normal forward motion (longitudinal axis), and the relative bearing is the angle of the satellite azimuth relative to the vehicle axis. The relative bearing is equal to the azimuth minus the heading. The satellite azimuth is calculated in the CDU 320 processor (not shown) from the satellite earth longitude (the latitude is nominally 0 since the UHF SATCOM satellites are in synchronous orbits) and the latitude/longitude position of the vehicle. The elevation of the satellite (the vertical component of the LOS) is also calculated for display and for manual setting of antenna elevation and to determine if the satellite of interest is in fact visible above the horizon from the vehicle location. Since the antenna is rotated relative to the housing which is fixed to the vehicle, the ASU 310 processor 314 calculates the bearing from the heading and azimuth in real time as the vehicle maneuvers and drives the ASU 310 motor 315 accordingly. In one embodiment, an angular velocity-sensing gyroscope 311 fixed to the ASU 310 housing measures vehicle yaw rate and drives the steering motor to rotate the antenna at the opposite angular rate, thus stabilizing its azimuth to the LOS. An angular velocity-sensing gyroscope 311 usually has its rate offset over time and temperature. In addition to providing vehicle track measurement, which is equal to heading for non-skidding land vehicular motion, a GPS receiver 313 is employed to also determine present position for LOS angle calculations and to provide magnetic variation for use with magnetic compass 312 measurements. In situations where the data from the GPS receiver 313 may be unreliable or unavailable, due to obstacles to reception, slow speed, parking, and reverse vehicle motion, for example, and to compensate for the nature of the GPS receiver 313 data (which can be non-continuous and have some latency), the angular velocity-sensing gyroscope 311 data, which is continuous and wideband, can be used. In this way, the features of the GPS receiver 313 and the angular velocity-sensing gyroscope 311 are combined in algorithms to better provide estimates of heading for the antenna steering system under all conditions. In addition, since moving vehicles operate in various modes and under various conditions, various algorithms can be used to accommodate for such variations. In one embodiment, these algorithms can be implemented with Kalman filters, for example. Other methods can also be used.

In one embodiment, the yaw gyro rate obtained from the angular velocity-sensing gyroscope 311 is integrated into heading and continuously compared to the GPS receiver 313 track in the ASU 310 processor 314. When the vehicle is in motion, and the GPS receiver 313 track is valid and stable, an adaptive control loop uses the comparison to calculate and maintain a time dependent and a temperature dependent estimate of offset for the angular velocity-sensing gyroscope 311. If and when the GPS receiver 313 data becomes unusable (for example, due to noisy reception or loss of reception), the angular velocity-sensing gyroscope 311 offset estimate is held constant and the angular velocity-sensing gyroscope 311 is used to steer the antenna system based on the optimized angular velocity-sensing gyroscope 311 heading estimate. On startup, the electronic magnetic compass 312 is used to validate the previously stored shutdown heading, or to modify it as necessary, until GPS receiver 313 track data becomes available.

In other embodiments, the antenna system can often be used for radio communications setup and can operate in extended periods of time in halt mode. GPS receiver 313 data may not be available in this mode. The angular velocity-sensing gyroscope 311 offset (for time and/or for temperature) can be "looped out" against this known condition of stable heading.

The ASU processor 314 can also be used to dynamically calibrate an electronic magnetic compass 312 sensor to the GPS receiver 313 track against magnetic distortions due to the vehicle installation. A correction table is stored and updated with the differences of heading between the GPS receiver 313 track and the magnetic compass 312 sensor heading, over 360°. This calibration can increase the accuracy of the startup validation, and can provide a reversionary steering mode whereby the data from the angular velocity-sensing gyroscope 311 and from the electronic magnetic compass 312 are combined to provide antenna steering information in the absence of GPS receiver 313 data. These modes of operation can be automatically determined and entered by the processors, thereby minimizing operator intervention.

Figure 4:
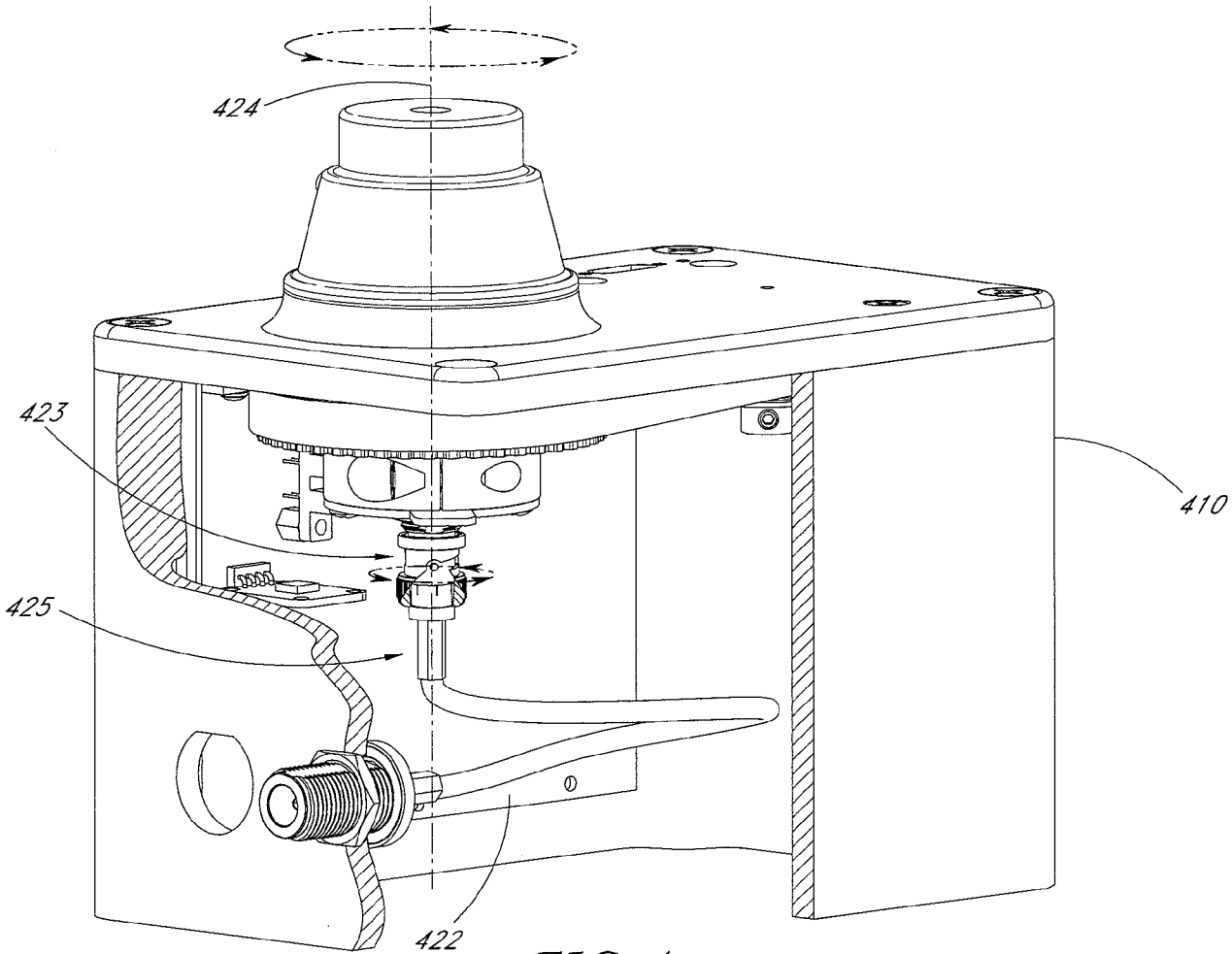
FIG. 4 shows details of an embodiment of the rotary joint connector in the ASU.

As explained above, the ASU 110 is connected to the antenna unit. This connection is enabled by a rotary joint connector. FIG. 4 shows details of an embodiment of the rotary joint connector in the ASU 410. Steering mechanisms such as the steering antenna system described herein commonly use a rotary joint. The rotary joint is usually precision-engineered so as to provide a general purpose, reliable, low-loss connection usable at relatively high rotations per minute (RPM) and a very wide RF bandwidth. As a result, such rotary joints are typically very expensive to make and are typically bulky. In one embodiment, the antenna unit is connected to the ASU 410 via an RF coaxial cable 422 terminated in BNC connectors 423. The antenna steering mechanism within the ASU 410 includes a set of gears that interconnect the rotary BNC connector joint 423 with an internal ring gear provided inside the support housing of the ASU 410. One end of the RF cable is thereby connected at the axis of rotation 424 of the antenna unit. As the antenna unit rotates about its axis of rotation 424, the gears rotate the rotary BNC connector joint 423 in synchronism with the antenna unit. In one embodiment, the rotary BNC connector joint 423 is designed to allow a reliable low impedance connection while occupying relatively minimal space. Such a rotary BNC connector joint 423 is also less expensive to produce than commonly-used precision-engineered rotary connectors, and uses fewer connectors in the complete antenna system. The BNC rotary connector joint 423 generally does not incur any significantly greater losses at UHF than a direct connection. Use of such a rotary BNC connector joint 423 allows the use of a relatively short length of cable, since the synchronous rotation of the BNC connector joint 423 with the antenna unit helps prevent cable twisting within the ASU because the end 425 of the RF cable 422 attached to the BNC connector joint 423 remains stationary.

Figure 5A:
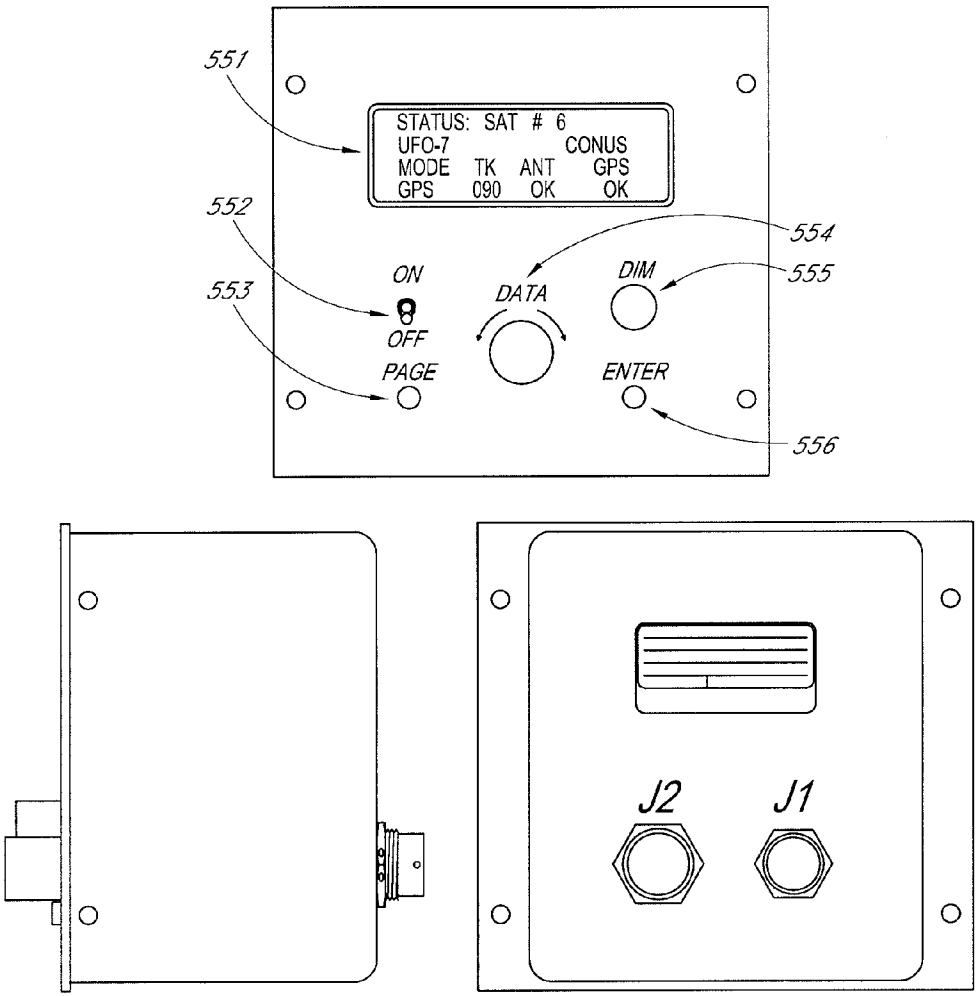
FIG. 5A shows an embodiment of the control and display unit (CDU).

As shown in, and described in reference to FIG. 1A above, the antenna unit 100 is connected to a CDU 120 usually located in the vehicle cockpit. FIG. 5A shows an embodiment of the CDU. In this embodiment, the CDU displays and controls include a digital display 551, a power switch 552, a page button 553, a data entry decoder 554, a backlight dimmer 555 and an enter button 556. The digital display 551 provides pages of data about the antenna steering system and guides operator entry of required data. The power switch 552 is used to turn the antenna system on or off. When the switch 552 is turned on, a source of 10-32 VDC from the vehicle is applied to the CDU and the ASU. The page button 553 is a push button (labeled PAGE) which selects and changes data pages for display. The data entry decoder 554 is a rotary control knob (labeled DATA) that allows operator selection and entry of required data. The backlight dimmer 555 is a rotary control knob (labeled DIM) which allows adjustment of the digital display backlighting brightness to accommodate ambient lighting conditions and relatively better viewing. The enter button 556 (labeled ENTER) selects data entry fields, causes data to be accepted and also acts as shift and/or tab key to advance the data entry position through other data items displayed on a given page.

In one embodiment, the CDU display is a 4 line by 20 character LCD array of alpha-numerics. Displays with greater or lesser number of lines and greater or lesser number of characters per line are also possible. In one embodiment, the data entry encoder provides 36 increments per rotation. Greater or lesser number of increments per rotation are also possible. For angular data such as heading, latitude and longitude, each increment can be a degree. For mode data, each increment can be a change of mode.

In one embodiment, the CDU is the control interface accessible to the operator for the selection of a satellite to be used in order to obtain information necessary to steer the antenna. In one embodiment, the CDU processor accepts user inputs of pushbuttons, data encoder, ASU response data, and sensor data. In one embodiment, the processor outputs a serial data bus to the ASU via a control cable.

Figure 5B:
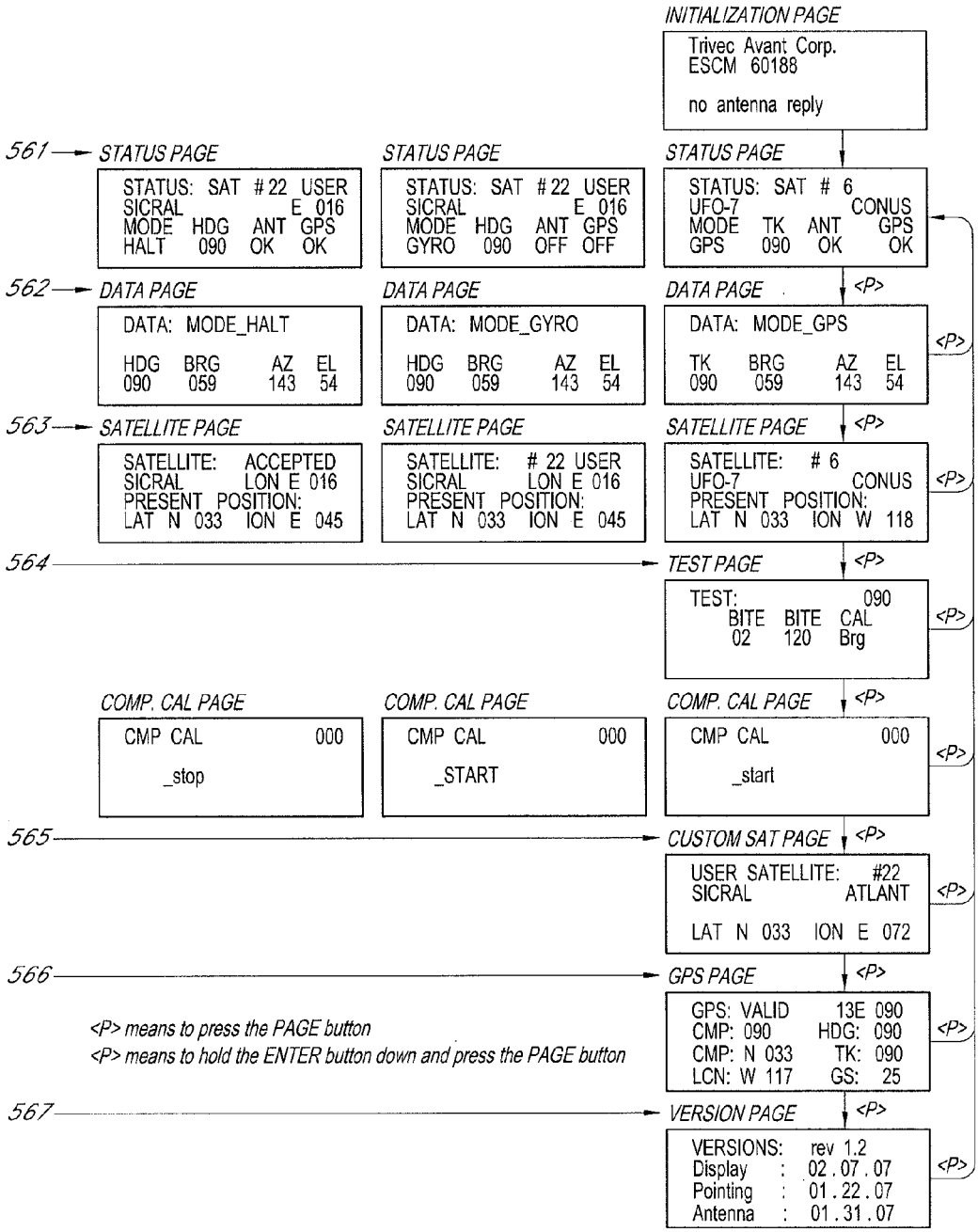
FIG. 5B shows different pages of an embodiment of the CDU.

FIG. 5B shows different pages of an embodiment of the CDU. These pages will be described in more detail below.

In one embodiment, there are three display pages that appear in rotation utilizing the PAGE button. These are the Status Page 561, the Data Page 562, and the Satellite Page 563. In one embodiment, the Status Page 561 displays the following information: page title, selected satellite number, name of satellite selected, satellite area, current steering mode, vehicle heading, antenna status, GPS status. In one embodiment, the Data Page 562 displays the following information: page title, current steering mode, vehicle heading, antenna bearing, satellite azimuth and satellite elevation. In one embodiment, the Satellite Page 563 displays the following information: satellite number, satellite name, present position latitude/longitude.

In one embodiment, MODE refers to the method of steering the antenna. The current steering mode for the antenna is shown on the display page as either "HALT", "GYRO", or "GPS".

Whenever the CDU microprocessor detects the presence of GPS data, GPS present position data shown on the Satellite Page 563 as present position "LAT" and "LON" is updated. In one embodiment, if the GPS data is indeterminate or missing, "OFF" is displayed on the Status Page 561. In this case, the microprocessor continues to automatically steer the antenna.

In one embodiment, the "HALT" mode means that the microprocessor is keeping the antenna fixed while calibrating internal sensors. This mode occurs when GPS data is invalid or when GPS ground speed is zero because the vehicle is stationary. Whenever GPS data is valid ("OK") and the vehicle motion is sufficient, the mode automatically changes to "GPS". When the GPS is OK, but the motion is very slow, other sensors are used to steer the antenna, and the mode is changed to "GYRO".

In one embodiment, when the system is first turned on, GPS may take a few seconds or minutes to become valid. The system assumes it is at a halt and steers to the last known satellite based on the last known heading. If the system has been moved such that the last heading at power down is not now correct, or if the system is turned on while moving, the system makes reference to an internal magnetic compass to realign heading. Also the system can be manually realigned when at HALT, if desired. If the heading number is manually changed in "GYRO" mode, restoring the "HALT" mode retains the heading change thereby realigning the gyro sensor.

The CDU can also be used by the operator to perform an alignment check. The operator navigates to the antenna bearing test page 564, and by rotating the data switch, rotates the antenna. The operator can then verify whether the antenna rotates and aligns with the front of the vehicle when the reading of bearing on the CDU indicates 000. If the alignment is not correct, a field alignment of azimuth is possible by using the CDU. The CDU can also be used to verify that the heading value displayed on the Status Page 561 or the Data Page 562 coincides with the actual heading of the vehicle referred to true North.

The satellite information stored in the CDU microprocessor is shown in the Table below.

| # | Satellite Name | Area of Coverage | West longitude (deg) |
|---|---|---|---|
| 1 | FSC-1 | Pacific | −173 |
| 2 | FSC-2 | Pacific | 176 |
| 3 | FSC-3 | Atlantic | 60 |
| 4 | FSC-4 | Indian Ocean | −39 |
| 5 | FSC-5 | Indian Ocean | −37 |
| 6 | FSC-7 | Pacific | −100 |
| 7 | FSC-8 | Atlantic | 15 |
| 8 | UFO-2 | Indian Ocean | −29 |
| 9 | UFO-3 | CONUS | 121 |
| 10 | UFO-4 | Pacific | 178 |
| 11 | UFO-5 | CONUS | 100 |
| 12 | UFO-6 | CONUS | 106 |
| 13 | UFO-7 | Atlantic | 22 |
| 14 | UFO-8 | Pacific | −171 |
| 15 | UFO-9 | Indian Ocean | −57 |
| 16 | UFO-10 | Indian Ocean | −73 |
| 17 | UFO-11 | Indian Ocean | −71 |
| 18 | NATO-4A | Atlantic | 18 |
| 19 | NATO-4B | Indian Ocean | −36 |
| 20 | SICRL-1 | Atlantic-Indian Ocean | −16 |
| 21 | SICRL-1 | Atlantic | −12 |
| 22 | SKY-4D | Atlantic | 34 |
| 23 | SKY-4E | Indian Ocean | −53 |
| 24 | SKY-4F | Atlantic-Indian Ocean | −6 |
| 25 | SKY-5 | Atlantic-Indian Ocean | 1 |
| 26 | LEASAT-1 | Pacific-Indian Ocean | −107 |
| 27 | LEASAT-2 | Atlantic | 38 |
| 28 | LEASAT-3 | CONUS | 98 |
| 29 | LEASAT-4 | Atlantic | 7 |
| 30 | LEASAT-5 | Pacific-Indian Ocean | −100 |

On the Satellite Page 563, any target satellite from the list can be selected if the line of sight to it is above the horizon. Satellite data can be entered and modified by the operator into all satellites, numbered 1 through 30.

Present position latitude and longitude of the vehicle is automatically taken from the GPS receiver data, but can also be entered on the Satellite Page 563 if the GPS data is not available. Using this information, the stored longitude of the satellite in use, and the heading of the vehicle, the CDU processor computes the azimuth and elevation of the line of sight to the satellite, as well as the relative bearing, for display on the data page 562 and for transmission to the ASU. The present position values are retained in nonvolatile memory during power-down.

Test Pages 564 are also accessible in the page sequence. Accidental access to the test pages 564 and possible disruption of normal system operation is prevented by requiring the use of special combination of keys for access. When using the Antenna Test Page, pointing can be changed and communications may be disrupted if attempted. If the pointing angle is changed in the Antenna Test Page, and the Test Page is exited, the antenna reverts to the original pointing angle. The original pointing angle is the pointing angle of the antenna before being modified in the Test Page.

The User Satellites page 565 allows the user to enter satellites in addition to those in the factory stored list, and to also modify the factory list.

The GPS Data page 566 displays the data received from the GPS and compass sensors.

The Version page 567 displays the firmware revision information.

The antenna system operates automatically with minimal user input. To communicate on the move, the user powers up the system and verifies the correctness of the information that the CDU displays on the Status Page 561. The CDU user interface can be used to select the desired satellite by name from a stored data list. The CDU allows the user to select a desired satellite from a list of stored satellite data, without necessarily knowing the elevation angle and/or the azimuth of the desired satellite. The user selection then allows the antenna system to determine relative bearing pointing. The ASU processor automatically uses the satellite data and the vehicle heading to point the antenna. The satellite elevation angle is displayed on the Data Page 562 of the CDU so that the antenna can be manually set to a specific elevation by the user. An angle within 20-30° is usually adequate for this adjustment.

Once the power is switched on, the CDU displays a boot-up page in the display window for a few seconds and then displays a text information page. This initial page is the Status Page described above. If the displayed satellite number and name correspond to the satellite intended for use, the displayed heading value is the general current heading of the vehicle, and the antenna status and GPS status will indicate "OK", and the system will be ready to start. When the satellite to be used is not the number and name shown on the display for the Status Page 561, the desired satellite number can be selected using the Satellite Page 563. The Status Page 561 will then indicate the newly selected satellite number and name.

No further action is required to maintain communications unless there is a change of parameters. For a change of satellites, the new satellite can be entered. If the GPS receiver loses data, the heading estimate will be maintained by the internal sensors. When the vehicle is parked/mobile for an extended time, the pointing will be held constant by the "HALT" mode, or by simply turning the system off.

It will be evident to those skilled in the art that the invention is not limited to the details of the foregoing illustrated embodiments and that the present invention may be embodied in other specific forms without departing from the spirit or essential attributed thereof; furthermore, various omissions, substitutions and changes may be made without departing from the spirit of the inventions. The foregoing description of the embodiments is, therefore, to be considered in all respects as illustrative and not restrictive, with the scope of the invention being delineated by the appended claims and their equivalents.

What is claimed is:

1. An antenna system for satellite communication mounted on a moving platform, comprising:

an antenna assembly, comprising:

a dipole driven element assembly; and at least one director element mounted on an antenna mast;

a control and display unit;

an antenna steering unit, comprising:

a support housing;

a rotary joint comprising a BNC connector, wherein the BNC connector has a first part connected to the support housing of the antenna steering unit, and a second part connected to the antenna assembly at an axis of rotation, such that when the antenna rotates, the BNC connector rotates in synchronism with the antenna;

an electronic magnetic compass for sensing the Earth magnetic field to determine a reference azimuth;

an angular velocity-sensing gyroscope for sensing motion and outputting an angular velocity output signal;

a global positioning system receiver for providing track of the moving platform;

a signal processor in communication with the electronic magnetic compass, the angular velocity-sensing gyroscope and the global positioning system receiver for receiving the reference azimuth, the angular velocity output signal, and the track, and determining a heading of the moving platform using an adaptive time interval; and a motor that controls direction of an azimuth axis of the antenna, wherein the direction of the azimuth axis of the antenna is determined based on the heading of the moving platform determined by the signal processor.

2. The antenna system of claim 1 wherein an elevation angle of the antenna mast is manually adjusted.

3. The antenna system of claim 1, wherein the antenna assembly further comprises a reflector assembly.

4. The antenna system of claim 1, wherein the dipole is linear-polarized.

5. The antenna system of claim 1, wherein the dipole is circular-polarized.

6. The antenna system of claim 1, wherein the dipole is elliptical-polarized.

7. The antenna system of claim 1 further comprising an azimuth mast.

8. The antenna system of claim 1, wherein the electronic magnetic compass comprises a sensor and a calibration table.

9. The antenna system of claim 1, wherein the signal processor further comprises Kalman filters.

10. The antenna system of claim 1, wherein the control and display unit is used by an operator of the moving platform for inputting selection of a satellite with which to communicate.

11. The antenna system of claim 1, wherein the control and display unit includes a user interface, user controls, at least one processor and a serial data bus for communication with the antenna steering unit.

12. The antenna system of claim 11, wherein the user interface comprises an LCD array of at least one line of at least sixteen alpha-numeric characters.

13. The antenna system of claim 11, wherein the user controls comprise a backlight dimmer for the user interface, a rotary knob comprising of at least twenty increments per rotation for inputting data, a button for selection of pages for display, and a button for accepting data.

14. The antenna system of claim 13, wherein the pages comprise at least a page to display status, a page to display satellite information and a page to display data.

15. An antenna system for satellite communication mounted on a moving platform, comprising:

an antenna assembly, comprising:

a dipole driven element assembly; and at least one director element mounted on an antenna mast;

a control and display unit;

a support housing;

a rotary joint comprising a BNC connector, wherein the BNC connector has a first part connected to the support housing of an antenna steering unit, and a second part connected to the antenna assembly at an axis of rotation, such that when the antenna rotates, the BNC connector rotates in synchronism with the antenna;

an electronic magnetic compass for sensing the Earth magnetic field to determine a reference azimuth;

an angular velocity-sensing gyroscope for sensing motion and outputting an angular velocity output signal;

a global positioning system receiver for providing track of the moving platform;

a signal processor in communication with the electronic magnetic compass, the angular velocity-sensing gyroscope and the global positioning system receiver for receiving the reference azimuth, the angular velocity output signal, and the track, and determining a heading of the moving platform using an adaptive time interval; and a motor that controls direction of an azimuth axis of the antenna, wherein the direction of the azimuth axis of the antenna is determined based on the heading of the moving platform determined by the signal processor.

16. An antenna system for satellite communication mounted on a moving platform, comprising:

an antenna assembly, comprising:

a dipole driven element assembly; and at least one director element mounted on an antenna mast;

a control and display unit;

an antenna steering unit, comprising:

a support housing;

a rotary joint comprising a BNC connector, wherein the BNC connector has a first part connected to the support housing of the antenna steering unit, and a second part connected to the antenna assembly at an axis of rotation, such that when the antenna rotates, the BNC connector rotates in synchronism with it;

an electronic magnetic compass for sensing the Earth magnetic field to determine a reference azimuth;

an angular velocity-sensing gyroscope for sensing motion and outputting an angular velocity output signal;

a signal processor in communication with the electronic magnetic compass, the angular velocity-sensing gyroscope and the angular velocity output signal, and determining a heading of the moving platform using an adaptive time interval; and a motor that controls direction of an azimuth axis of the antenna, wherein the direction of the azimuth axis of the antenna is determined based on the heading of the moving platform determined by the signal processor.

* * * * *